US006341992B1

(12) United States Patent
Eglinsdoerfer et al.

(10) Patent No.: US 6,341,992 B1
(45) Date of Patent: Jan. 29, 2002

(54) BOAT STEERING TORQUE COMPENSATOR

(75) Inventors: Harry Eglinsdoerfer, Stockton; James Brown, Ione, both of CA (US)

(73) Assignee: Torque Control Steering System, LLC, Carson City, NV (US)

( * ) Notice: Subject to any disclaimer, the term of this patent is extended or adjusted under 35 U.S.C. 154(b) by 0 days.

(21) Appl. No.: 09/481,742

(22) Filed: Jan. 11, 2000

(51) Int. Cl.[7] ..... B63H 20/12

(52) U.S. Cl. ..... 440/53; 114/144 R; 440/62; 440/63

(58) Field of Search ..... 114/144 R; 440/53, 440/55, 62, 63

(56) References Cited

U.S. PATENT DOCUMENTS

| | | | | |
|---|---|---|---|---|
| 2,895,445 A | * | 7/1959 | Foraker | 440/62 |
| 4,263,994 A | | 4/1981 | Hayes | |
| 4,362,515 A | * | 12/1982 | Ginnow | 440/62 |
| 5,423,277 A | | 6/1995 | Gai | |

* cited by examiner

*Primary Examiner*—Sherman Basinger
(74) *Attorney, Agent, or Firm*—Jack Lo

(57) ABSTRACT

The present boat steering torque compensator is for being attached to a boat with a pivotable outboard motor, and a linearly movable control shaft with a first end connected to the outboard motor and a second end connected to a steering wheel. The compensator is comprised of a tube for being attached to the boat in a fixed position parallel to the control shaft. A compression spring positioned in the tube has a fixed first end adjacent the first end of the control shaft, and a movable second end. An elongated shaft positioned in the tube and through the spring has a first end connected to the first end of the control shaft by an adapter arm, and a second end positioned adjacent the movable second end of the spring. An engaging member on the second end of the elongated shaft engages the movable second end of the spring to compress the spring when the control shaft and elongated shaft are moved in the direction of the first end of the tube. As a result, the tendency of the motor to pivot under the influence of motor torque is opposed by the spring. The engaging member on the elongated shaft disengages and moves away from the movable second end of the spring when the control shaft and elongated shaft are moved in the direction of the second end of the tube, so that the control shaft is free to move independently of the spring.

8 Claims, 3 Drawing Sheets

BOAT STEERING TORQUE COMPENSATOR

BACKGROUND OF THE INVENTION

1. Field of the Invention

This invention relates generally to mechanisms for countering the steering torque of a boat.

2. Prior Art

A typical prior art outboard motor 10 for a boat is shown in FIG. 1. Motor 10 is pivoted about a vertical axle 11 on a motor mount 12 attached to the stern of a boat (not shown). A control shaft 13 is movably positioned through a sleeve 14 extending transversely through motor mount 12. A follower shaft 15 is positioned through another sleeve 16 in parallel with control shaft 13. A connecting bar 17 is connected between a first end 18 of control shaft 13 and a first end 19 of follower shaft 15, so that when control shaft 13 is moved, follower shaft 15 is moved simultaneously. A link arm 20 is hinged between motor 10 and connecting bar 17. Motor 10 is steered to turn right by moving control shaft 13 toward the right of the figure, and steered to turn left by moving control shaft 13 toward the left of the figure.

The torque generated by motor 10 tends to pivot motor 10 counterclockwise about axle 11 and steer the boat right, as shown in FIG. 2. The driver of the boat must constantly resist the right-turning tendency by counter steering with the steering wheel. The constant application of counter steer is tiring. Further, if the driver releases the steering wheel, or if there is a failure in the steering linkage, the torque from motor 10 will automatically snap the boat into a sharp, uncontrolled right turn.

A steering mechanism disclosed in U.S. Pat. No. 4,263,994 to Hayes prevents outboard motor torque from feeding back to a steering wheel. It is a replacement for a preexisting steering mechanism, not an add-on. It requires numerous arms and links, so that it is complicated to make and install.

OBJECTS OF THE INVENTION

Accordingly, objects of the present boat steering torque compensator are:

- to precisely counteract torque from an outboard motor;
- to eliminate the need for a driver to apply counter steer on the steering wheel;
- to eliminate a boat's natural tendency to turn even when the driver releases the steering wheel, or during steering linkage failure; and
- to be easily retrofitted to a boat without modifying or dissembling an existing steering linkage.

Further objects of the present invention will become apparent from a consideration of the drawings and ensuing description.

BRIEF SUMMARY OF THE INVENTION

The present boat steering torque compensator is for being attached to a boat with a pivotable outboard motor, and a linearly movable control shaft with a first end connected to the outboard motor and a second end connected to a steering wheel. The compensator is comprised of a tube for being attached to the boat in a fixed position parallel to the control shaft. A compression spring positioned in the tube has a fixed first end adjacent the first end of the control shaft, and a movable second end. An elongated shaft positioned in the tube and through the spring has a first end connected to the first end of the control shaft by an adapter arm, and a second end positioned adjacent the movable second end of the spring. An engaging member on the second end of the elongated shaft engages the movable second end of the spring to compress the spring when the control shaft and elongated shaft are moved in the direction of the first end of the tube. As a result, the tendency of the motor to pivot under the influence of motor torque is opposed by the spring. The engaging member on the elongated shaft disengages and moves away from the movable second end of the spring when the control shaft and elongated shaft are moved in the direction of the second end of the tube, so that the control shaft is free to move independently of the spring.

DRAWING REFERENCE NUMERALS

10. Outboard Motor
11. Axle
12. Motor Mount
13. Control Shaft
14. Sleeve
15. Follower Shaft
16. Sleeve
17. Connecting Bar
18. First End
19. First End
20. Link Arm
30. Tube
31. First End
32. Second End
33. Mounting Bracket
34. Spring
35. First End
36. Second End
37. End Cap
38. Washer
39. End Cap
40. Washer
41. Elongated Shaft
42. First End
43. Adapter Arm
44. Second End
45. Nut
46. Engaging Member
47. U-Bolts

DETAILED DESCRIPTION OF THE INVENTION

Figure 1:
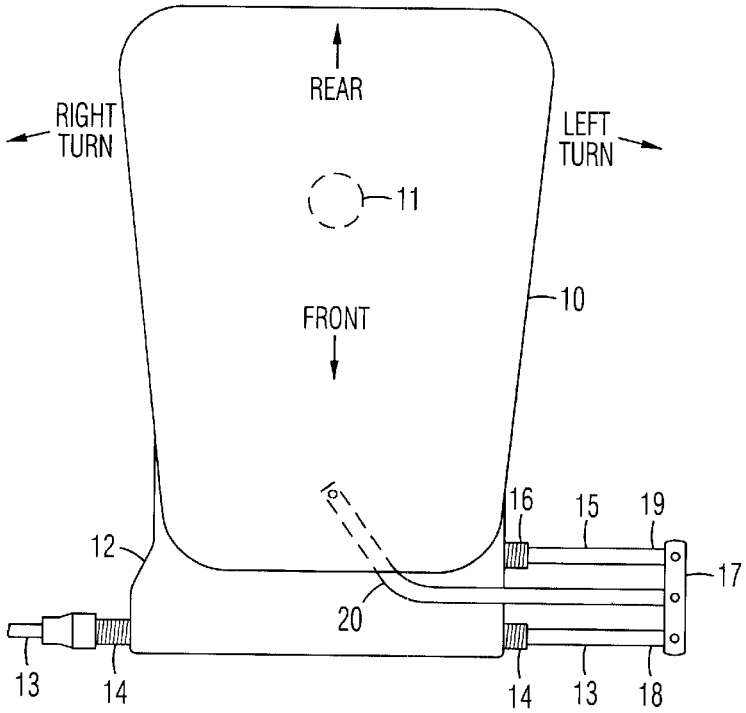
Fig. 1 Prior Art
FIG. 1 is a top view of a prior art boat outboard motor in a neutral position.
Figure 2:
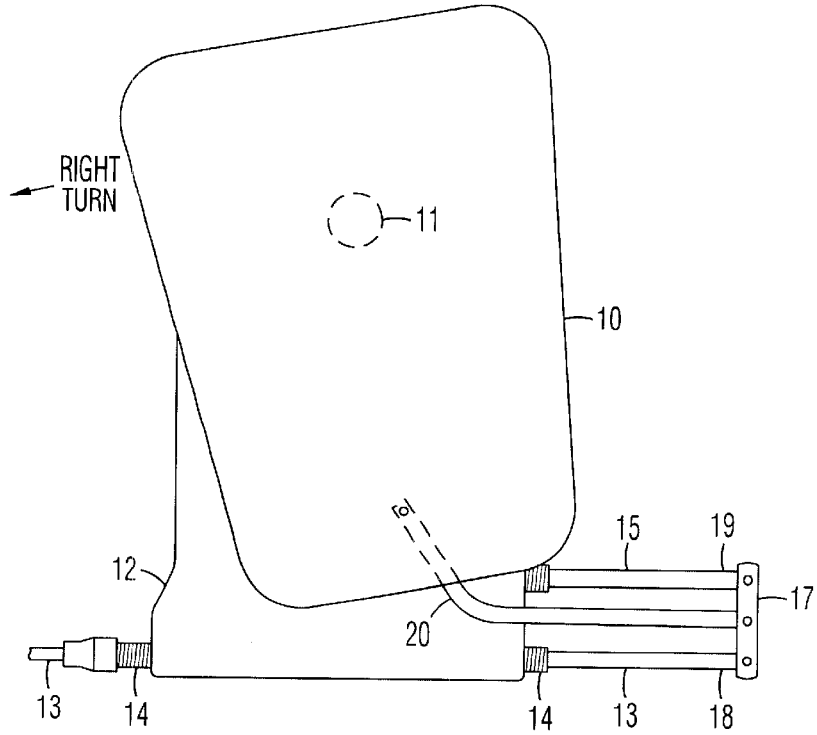
Fig. 2 Prior Art
FIG. 2 is a top view of the prior art outboard motor steered to turn right by motor torque.
Figure 3:
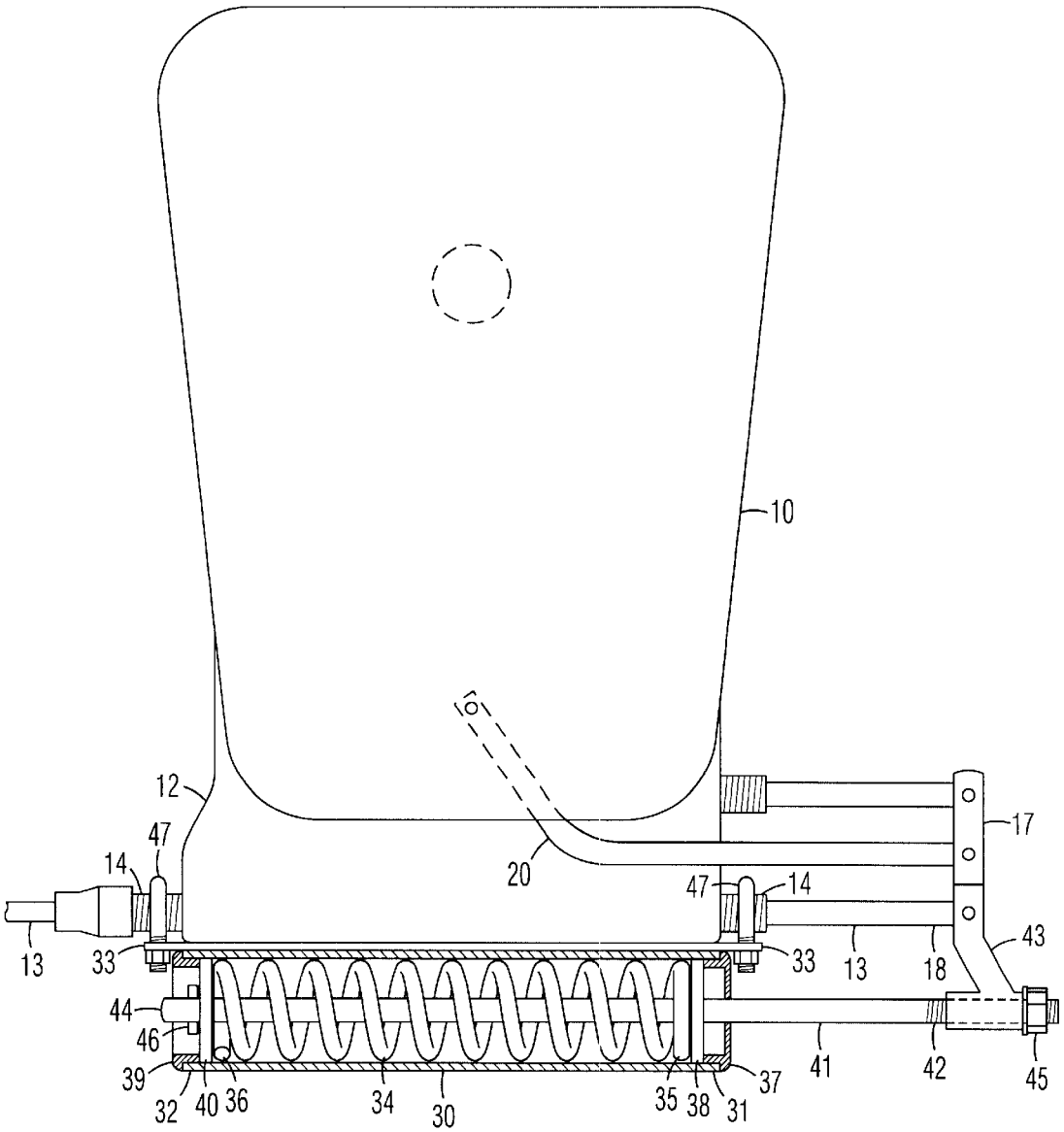
FIG. 3 is a top view of the present torque compensator attached to the outboard motor.

FIG. 3:

A preferred embodiment of the present boat steering torque compensator is shown in a top view in FIG. 3. It includes a tube 30 with a first end 31 adjacent first end 18 of control shaft 13, and an opposite second end 32. Mounting brackets 33 are attached to opposite ends of tube 30. Tube 30 is for being attached to the boat in a fixed position generally parallel to control shaft 13 adjacent motor 10. Tube 30 is preferably attached to motor mount 12 with U-bolts 47 wrapped around opposite ends of sleeve 14 and attached to mounting brackets 33.

A compression spring 34 in tube 10 has a fixed first end 35 and a movable second end 36 in corresponding positions with first and second ends 31 and 32, respectively, of tube 10. Fixed first end 35 of spring 34 is abutting a first end cap 37 and a fixed first washer 38 at first end 31 of tube 10. The extension limit for movable second end 36 of spring 34 is defined by a second end cap 39 and a movable second washer 40 at second end of 32 of tube 10.

An elongated shaft 41 positioned in tube 10 and through spring 34 has a first end 42 connected to first end 18 of control shaft 13 and connecting bar 17 by an adapter arm 43, and a second end 44 positioned adjacent movable second end 36 of spring 34. During installation, elongated shaft 41 and motor 10 are arranged in the neutral positions shown, and adapter arm 43 is adjusted along elongated shaft 41 by adjusting a nut 45 thereon to meet first end 18 of control shaft 13. An engaging member 46 near second end 44 of elongated shaft 41 engages movable second washer 40 and movable second end 36 of spring 34.

The torque compensator is thus easily retrofitted to an existing outboard motor without modifying or dissembling the existing steering linkage on the boat.

Figure 4:
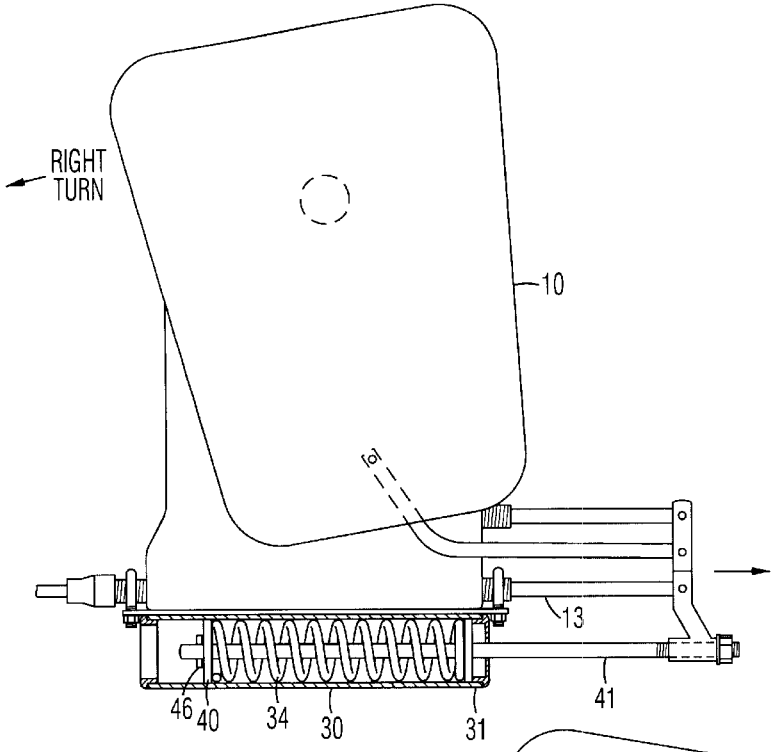
FIG. 4 is a top view of the torque compensator opposing a right turn caused by motor torque.

FIG. 4:

When control shaft 13 and elongated shaft 41 are moved in the direction of first end 31 of tube 30 under the influence of motor torque, their movement is resisted by spring 34, as shown in FIG. 4. Spring 34 is selected to have a strength just enough to counter the torque of a selected motor or a range of motors. The driver of the boat is relieved from constantly applying counter steer on the steering wheel against the torque-induced turning tendency. Steering is thus much easier and less fatiguing. If the steering wheel is released by the driver, or if there is a failure in the steering linkage during a right turn, spring 34 will gently return to its maximum extension and return the boat to a straight ahead course.

Figure 5:
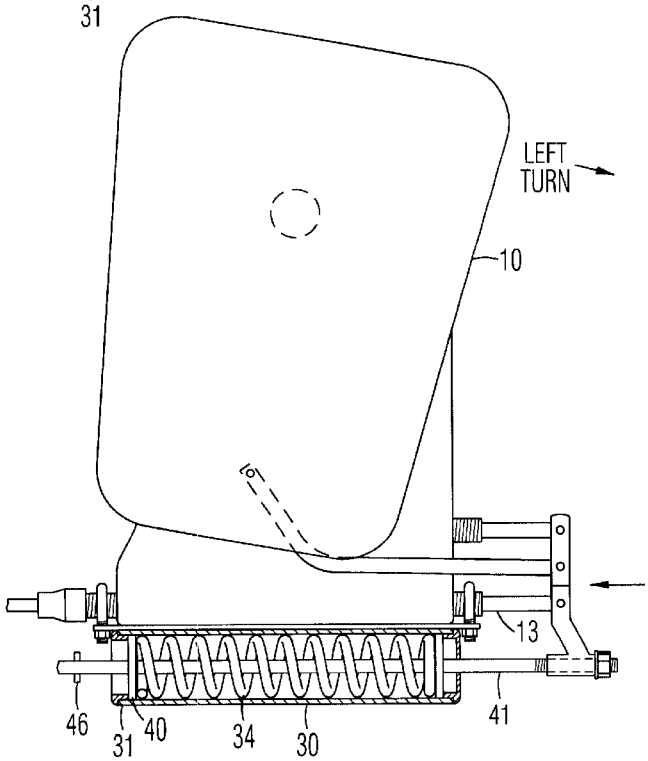
FIG. 5 is a top view of the torque compensator allowing the motor to freely turn left.

FIG. 5:

When control shaft 13 and elongated shaft 41 are moved in the direction of second end 31 of tube 30, such as during a controlled left turn, engaging member 46 on elongated shaft 41 is disengaged from washer 40 and spring 34, so that control shaft 13 and elongated shaft 41 are free to move independently of spring 34, as shown in FIG. 5.

SUMMARY AND SCOPE

Accordingly, the present boat steering torque compensator precisely counteracts torque from an outboard motor. It eliminates the need for a driver to constantly apply counter steer on the steering wheel. It eliminates a boat's natural tendency to turn even when the driver releases the steering wheel, or during steering linkage failure. It is also easily retrofitted to a boat without dissembling or modifying the steering linkage.

Although the above description is specific, it should not be considered as a limitation on the scope of the invention, but only as an example of the preferred embodiment. Many variations are possible within the teachings of the invention. For example, the compensator may be provided as a built-in part of a motor mount. The spring may be an extension spring, and the elongated shaft may be rearranged to engage the extension spring. The spring may comprise any type of resilient resistance device, such as a hydraulic cylinder. Therefore, the scope of the invention should be determined by the appended claims and their legal equivalents, not by the examples given.

What is claimed is:

1. A steering torque compensator for a boat with a pivotable outboard motor, and a linearly movable control shaft with a first end connected to said outboard motor and a second end, said steering torque compensator comprising:

a spring for being connected to said boat, said spring including a fixed first end and a movable second end movable along a path adapted to be generally parallel to said first end of said control shaft; and an elongated shaft extending along said path of motion of said movable second end of said spring, said elongated shaft including a first end for connecting to said first end of said control shaft, and a second end engaging said movable second end of said spring when said elongated shaft is linearly moved in a first direction, said second end of said elongated shaft disengaging from said movable second end of said spring when said elongated shaft is linearly moved in an opposite second direction;

wherein said spring is arranged to provide resistance when said movable second end thereof is moved in said first direction; so that when said control shaft is moved in said first direction under influence of motor torque, movement of said elongated shaft and therefore said control shaft is resisted by said spring for countering said motor torque, and when said control shaft is moved in said second direction, movement of said elongated shaft and therefore said control shaft is not resisted by said spring.

2. The steering torque compensator of claim 1, wherein said spring is comprised of a compression spring.

3. The steering torque compensator of claim 1, further including an adapter arm attached to said first end of said elongated shaft, said adapter arm being adjustable along said elongated shaft for aligning with and attaching to said first end of said control shaft.

4. A steering torque compensator for a boat with a pivotable outboard motor, and a linearly movable control shaft with a first end connected to said outboard motor and a second end, said steering torque compensator comprising:

a tube with a first end and a second end, said first end of said tube for being positioned adjacent said first end of said control shaft, said tube for being attached to said boat in a fixed position generally parallel to said control shaft;

a spring positioned in said tube; and an elongated shaft positioned in said tube, said elongated shaft including a first end for connecting to said first end of said control shaft, and a second end arranged to engage said-spring, movement of said elongated shaft being resisted by said spring when said elongated shaft is linearly moved in a first direction, and not resisted by said spring when said elongated shaft is linearly moved in a second direction;

wherein when said control shaft is moved in said first direction under influence of motor torque, movement of said elongated shaft and therefore said control shaft is resisted by said spring for countering said motor torque, and when said control shaft is moved in said second direction, movement of said elongated shaft and therefore said control shaft is not resisted by said spring.

5. The steering torque compensator of claim 4, wherein said spring is comprised of a compression spring.

6. The steering torque compensator of claim 4, further including an adapter arm attached to said first end of said elongated shaft, said adapter arm being adjustable along said elongated shaft for aligning with and attaching to said first end of said control shaft.

7. A steering torque compensator for a boat with a pivotable outboard motor, and a linearly movable control shaft with a first end connected to said outboard motor and a second end, said control shaft movable within a fixed sleeve, said steering torque compensator comprising:

a tube with a first end and a second end, said first end of said tube for being positioned adjacent said first end of said control shaft, said tube for being arranged in a fixed position generally parallel to said control shaft;

a pair of mounting brackets attached to said tube;

a pair of U-bolts respectively attached to said mounting brackets, said U-bolts for securely attaching to said sleeve;

a compression spring positioned in said tube, said spring including a fixed first end and a movable second end respectively corresponding to said first end and said second end of said tube; and an elongated shaft positioned in said tube and through said spring, said elongated shaft including a first end for connecting to said first end of said control shaft, a second end positioned adjacent said movable second end of said spring, and an engaging member attached adjacent said second end thereof, said engaging member engaging said movable second end of said spring when said elongated shaft is linearly moved toward said first end thereof, and disengaging from said movable second end of said spring when said elongated shaft is linearly moved toward said second end thereof;

wherein when said control shaft is moved toward said first end thereof under influence of motor torque, movement of said elongated shaft and therefore said control shaft is resisted by said spring for countering said motor torque, and when said control shaft is moved toward said second end thereof, movement of said elongated shaft and therefore said control shaft is not resisted by said spring.

8. The steering torque compensator of claim 7, further including an adapter arm attached to said first end of said elongated shaft, said adapter arm being adjustable along said elongated shaft for aligning with and attaching to said first end of said control shaft.

* * * * *